United States Patent [19]

Parramore

[11] Patent Number: 4,665,577

[45] **Date of Patent: * May 19, 1987**

[54] METHODS OF CONSTRUCTING MODULAR BRIDGES

[75] Inventor: Thomas S. Parramore, Christchurch, England

[73] Assignee: Fairey Engineering Limited, Stockport, England

[ * ] Notice: The portion of the term of this patent subsequent to Jun. 11, 2002 has been disclaimed.

[21] Appl. No.: 742,478

[22] Filed: Jun. 7, 1985

Related U.S. Application Data

[63] Continuation-in-part of Ser. No. 447,550, Dec. 7, 1982, Pat. No. 4,521,932.

[30] Foreign Application Priority Data

Jun. 14, 1984 [GB] United Kingdom ..... 8415136

[51] Int. Cl.[4] ..... E01D 15/12

[52] U.S. Cl. ..... 14/2.4

[58] Field of Search ..... 14/24, 26, 17, 73, 1; 269/289 M

[56] References Cited

U.S. PATENT DOCUMENTS

| | | | |
|---|---|---|---|
| 3,504,389 | 4/1970 | Longbottom | 14/13 |
| 3,651,528 | 3/1972 | Behrmann et al. | 14/27 |
| 4,288,881 | 9/1981 | Mahncke et al. | 14/2.4 |
| 4,299,002 | 11/1981 | Wagner et al. | 14/2.4 |
| 4,521,932 | 6/1985 | Parramore | 14/2.4 |

FOREIGN PATENT DOCUMENTS

| | | | |
|---|---|---|---|
| 2116120 | 10/1972 | Fed. Rep. of Germany | 14/2.4 |
| 2530359 | 1/1977 | Fed. Rep. of Germany | 14/2.4 |
| 2477599 | 9/1981 | France | 14/2.4 |
| 2929208 | 2/1981 | German Democratic Rep. | 14/2.4 |
| 180327 | 8/1962 | Sweden | 14/2.4 |
| 2039311 | 8/1980 | United Kingdom | 14/2.4 |

*Primary Examiner*—Stephen J. Novosad
*Assistant Examiner*—Bruce M. Kisliuk
*Attorney, Agent, or Firm*—Millen & White

[57] ABSTRACT

A method of constructing a modular bridge across a span comprises at least a first trestle on the home bank of the span, placing a first module of a modular launching rail on the trestle, connecting one or more subsequent launching rail modules to the launching rail being formed, placing a first bridge module on the launching rail, connecting one or more subsequent bridge modules to the bridge being formed, booming out the launching rail across the span and launching the bridge across the span along the launching rail. A trestle for use in such a method is also disclosed.

16 Claims, 50 Drawing Figures

221
1
13
A
223
135
C
D
183

221
1
1
13
A
135
C
D
183

221
1
1
225
13
A
135
C
D
E
183

13
225
A
223
135
C
D
E
183

75
W
A
C
E

A
W
75
31
E
C

A
W
A
227
E
C

W
A
B
135
E
C

W
B
A
135
E
C
75

W
B
A
E
C

METHODS OF CONSTRUCTING MODULAR BRIDGES

RELATED PATENT APPLICATIONS

The instant application is a continuation-in-part of U.S. patent application Ser. No. 447,550, filed Dec. 7, 1982 now U.S. Pat. No. 4,521,932.

BACKGROUND OF THE INVENTION (1) Field of the Invention

This invention relates to a method of constructing a modular bridge across a span and to apparatus for use in such a method.

In military operations, it is desirable, if not essential, to have a capability for allowing heavy ground equipment, such as tanks, to cross difficulties in terrain. Such difficulties may include gaps formed by ditches, canals and rivers. Although the construction of a bridge for light vehicles is comparatively straight forward, providing a bridge which is capable of supporting a tank is of considerably greater difficulty.

(2) Information disclosure statement

No. EP-A-0081388 discloses a modular bridge comprising at least one intermediate bridge module and two end bridge modules, each of the bridge modules comprising two longitudinal main girder structures and an intermediate deck having a deck surface, the main girder structures being foldably connected one along each side of the deck and being foldable from an operative position in which the main girder structures offer extensions of the deck surface on either side of the deck for use to a closed position in which the main girder structures are folded beneath the deck, the main girder structures of the end bridge modules being longitudinally tapered in depth when seen from a side of the module in its operative position, the main girder structures of the intermediate module(s) not being so tapered, wherein each of the end bridge modules and the intermediate bridge module(s), are connected to form a bridge.

No. EP-A-0081388 discloses the construction of such bridge by putting up a building frame, having upwardly facing rollers, on the first bank of the span to be crossed. A preliminary beam is assembled on the frame and pushed outwards towards the bank. The bridge assembly is assembled progressively on the frame, behind the preliminary beam, with the beam being attached to the leading module. The preliminary beam has at its outer end a jacking unit with support rollers so that, when the jacking unit reaches the far bank of the span, it may rest on it and allow the assembly of beam and bridge to roll across the span, the bridge assembly is then lowered onto the bank and the beam withdrawn back through the bridge assembly. This procedure is illustrated in FIGS. 23A to 23F of No. EP-A-0081388.

No. EP-A-0075671 discloses a demountable non-opening bridge comprising discrete channel-section modules and an H-section launching girder, wherein modules comprise a central part and two wing parts, the wing parts comprise box-section track girders, the two wing parts are downwardly hinging below the central part for transportation, in the laying of the bridge the launching girders are assembled and made first, whereafter the various modules are coupled together and pushed over the launching girder and the launching girder remains in the bridge as a bearing element.

No. EP-A-0075671 discloses the construction of such a bridge by the joint use of a laying vehicle having a cantilever arm and a four-tonne crane. The laying vehicle moves to the bank of the span to be crossed with a launching girder ramp (or end) member already in position on guide rollers of the cantilever arm. The cantilever arm comprises a pinion to advance the ramp member over the span by means of a co-operating rack. The crane delivers launching girder inner sections which are coupled up and advanced. Once the launching girder has reached the required length, a second launching girder ramp (end) member is coupled up. The cantilever arm.of the laying vehicle is lowered so that the launching girder is then supported by its own hydraulically deployable feet. A ramp (end) bridge module is now lifted by the crane onto the launching girder. Inner (intermediate) bridge modules are coupled up and drawn over the launching girder by means of a block and tackle and reversing roller. The final module is a further ramp (end) module. The hydraulic feet are then retracted. This construction sequence is as illustrated in FIG. 6 of No. EP-A-0075671.

No. EP-A-0075611 also discloses the use of a single laying vehicle combining the capabilities of the laying vehicle and crane described above. It is equipped both with a cantilever arm and with a four-tonne crane.

BRIEF SUMMARY OF THE INVENTION

The present invention enables the construction of a modular bridge across a span without the requirement for specialist vehicles. Furthermore, it is desirable for bridges of this type to be capable of being built quickly, even at night, by few men.

According to a first aspect of the present invention, there is provided a method of constructing a modular bridge across a span, the method comprising placing at least a first trestle on the home bank of the span, placing a first module of a modular launching rail on the trestle, connecting one or more subsequent launching rail modules to the launching rail being formed, placing a first bridge module on the launching rail, connecting one or more subsequent bridge modules to the bridge being formed, booming out the launching rail across the span and launching the bridge across the span along the launching rail.

DESCRIPTION OF THE PREFERRED EMBODIMENTS

The first trestle preferably has one or more rollers for supporting the launching rail, the rollers desirably being drivable to move the launching rail over the beam of the first trestle. The first trestle also preferably comprises one or more rollers for supporting the bridge modules.

A trestle suitable for use in the above method of construction forms a second aspect of the invention, according to which there is provided a trestle comprising a support beam lockably movable, on one or more guideposts, towards and away from the ground on which the trestle is located, means for supporting a bridge launching rail on the beam in such a way that the rail can move over the beam, means for supporting a bridge module on the beam in such a way that the bridge module can move over the beam and means for moving the rail over the beam. The launching rail is preferably of inverted-T shaped configuration. This configuration allows the effective use of lateral guide means, for the launching rail, to be positioned on the trestle. The lateral guide means for the launching rail may comprise retractable pinch wheels. Because of the use of a trestle it is a simple matter also to provide lateral guide means for the bridge modules, which may comprise one or more vertically mounted guide rollers. In addition, the trestle may comprise means for selectively restraining the launching rail during construction: the selective restraining means desirably comprise retractably hooks.

It is a preferred feature of the first trestle that it comprises means for adjusting the level of the trestle.

In a preferred aspect of the method, a second trestle is placed on the home bank to take a proportion of the load of the modules. The second trestle will desirably be of similar construction to the first trestle, except that it is not necessary for it to be provided with retaining means such as hooks or means for moving the rail over the beam, such as powered rollers. Each bridge module is preferably substantially described in No. EP-A-0081388 in that it comprises two longitudinal main girder structures and an intermediate deck having a deck surface, the main girder structures being foldably connected one along each side of the deck and being foldable between an operative position in which the main girder structures offer extensions of the deck surface on either side of the deck for use and a closed position in which the main girder structures are folded beneath the deck. A bridge formed of such modules will normally comprise two end modules, in each of which the main girder structures are longitudinally tapered in depth when seen from the side of the module and at least one intermediate module in which the main girder structures are not so tapered.

Some preferred features of modules suitable for use in the method of the present invention are the same as or closely similar to the preferred features of the modules disclosed in No. EP-A-0081388. Thus, it is desirable that the main girder structures be box girder structures; that each main girder structure comprise at least one lifting attachment on a surface offering the extension of the deck surface; that each of the lifting attachments be recessed; that each main girder structure comprise at least one lifting attachment on a surface which is facing a corresponding surface of the other main girder structure when the module is in the operative position; that the deck comprise two lip portions and that each of the main girder structures comprise a shoulder portion, each of which lip portions stays on a respective one of the shoulder portions when the module is in the operative position; and/or that the module further comprise a bracing means between the main girder structure for bracing the module when in the operative position.

In No. EP-A-0081388, the disclosed bracing means comprised steel bracing wires. In a preferred module suitable for use in the present invention, the bridge modules preferably comprise bracing arms, one end of each of which is pivotably attached either to a main girder structure or to the deck surface, and the other end of which is receivable in a slide in the other of the main girder structure and the deck. Preferably, the bracing arm is pivotably attached to a main girder structure and receivable in a slide in the deck.

A further preferred feature of a bridge module usable in the present invention concerns means for joining adjacent bridge modules. In No. EP-A-0081388, joining plates are provided at each end of each of the intermediate bridge modules and at the inner end of each of the end modules. Each joining plate would be provided with a hole to receive a pin when joining plates of adjacent bridge modules are placed together. So much is similar with the present case. In the prior disclosure, however, pairs of joining plates would be provided at one end of the bridge module and would be adapted to lie either side of single joining plates of adjacent bridge modules. A pin would be manually inserted through the resulting laminate of joining plates to hold the modules together. In the present case, there are two improvements to this structure. First, the arrangement of joining plates is hermaphrodite in nature. It therefore does not matter which way round the intermediate bridge modules are. Secondly, means may be provided for remotely inserting a pin through a laminate of joining plates, each of which is provided with a pin-receiving hole. Such means may take the form of a bell-crank lever, adapted to be operable from the side of a bridge module when in position on the launching rail and arranged to move a pin through a laminate of joining plates. By this arrangement, it is not necessary for a man to go underneath the bridge during construction, thereby saving time.

A preferred feature of the method of the invention involves the use of means for altering the angle of approach offered by one or both of the end bridge modules. Such means may take the form of a hydraulically operable articulating ram for moving a tapered portion of the end bridge module with respect to a connecting portion of the module, which is adapted to connect to the end module to an adjacent intermediate module. One or more filling elements may be inserted in the end module so that the hydraulic cylinders can be relaxed after articulation.

It is particularly appropriate for further module bracing means, in addition to or instead of those described previously, to be provided. To this end, each bridge, comprising a number of modules, may be provided with a sub-frame for bracing frame for (a) bracing the bridge in the open position and (b) supporting the bridge on the launching rail so that it can be boomed out across the span. A sub-frame may be provided at each end of a bridge, preferably being located at the inner end of each of the end modules. Each sub-frame preferably has a pair of rollers, one for bearing on each flange of the inverted T-section of the launching rail.

BRIEF DESCRIPTION OF THE DRAWINGS

For a better understanding of the present invention, and to show how it may be put into effect, reference will now be made by way of example to the accompanying drawings, in which.

DETAILED DESCRIPTION

Figure 1A:
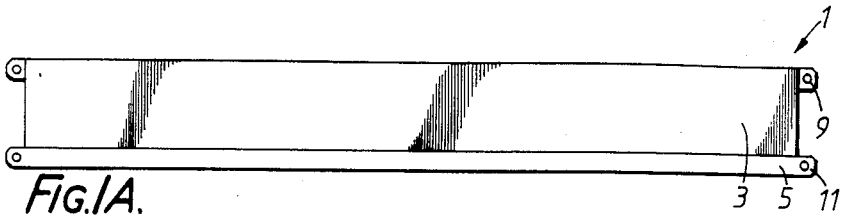
FIG. 1A, 1B and 1C show side elevation, plan and end views of an intermediate launching rail module.
Figure 1B:
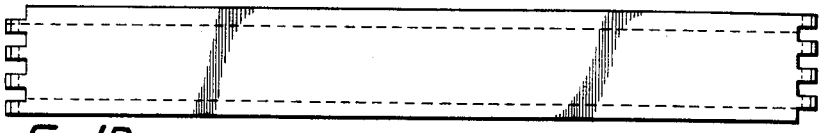
Figure 1C:
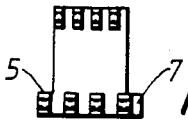

Referring now to the drawings, FIGS. 1A to 1C and FIGS. 2A to 2C show the modules from which the launching rail used in the invention is built up. FIGS. 1A, 1B and 1C show an intermediate launching rail 1, which is of a length of 19 feet 6 inches (5.94 meters) which ensures that the launching rail modules are compatible for transport with the ISO 6.1 meters (20 feet) container system. Each intermediate launching rail module weighs about 0.8 tonnes and comprises a longitudinal upstanding member 3 which carries, at its lower edge, a pair of flanges 5 and 7. The intermediate launching rail module thus has the configuration of an inverted-T. Each is provided with a tension connection for connection to a bridge module, as will be described later. At the upper and lower edges each of each intermediate launching rail module 1 is a row of joining lugs for connecting the module with an adjacent module. The upper row of lugs is designated by reference numeral 9 and the lower row by reference numeral 11. The joining lugs are so positioned that each intermediate launching rail module 1 is hermaphrodite in nature and can therefore connect with any other module. Horizontal pins (not shown) can be inserted through aligned holes in cooperating rows of joining lugs in adjacent launching rail modules.

Figure 2A:
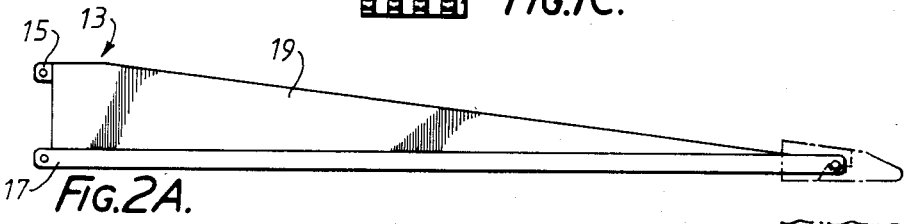
FIGS. 2A, 2B and 2C show side elevation, plan and end views of an end launching rail module.
Figure 2B:
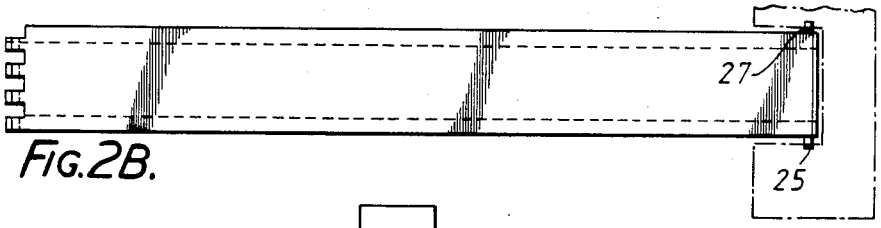
Figure 2C:
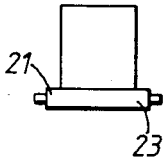
Figure 3A:
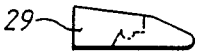
FIGS. 3A, 3B and 3C show side elevation, plan and end views of a bearing pad for use in conjunction with an end module of a launching rail.
Figure 3B:
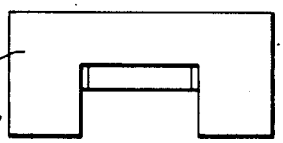
Figure 3C:
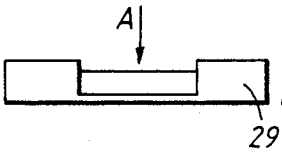

An end launching rail module 13 is shown in FIGS. 2A, 2B and 2C. The left-hand end of the module in FIGS. 2A and 2B is equipped with upper and lower rows of joining lugs 15 and 17, corresponding to the rows of joining lugs 9 and 11 described above for the intermediate launching rail module 1. The end launching rail module 13 comprises a tapered (when viewed from the side) longitudinal member 19 in the place of the longitudinal member 3 described for the intermediate launching rail module 1. The end launching rail module 13 also has lower flanges 21 and 23 and, in this respect, is also of a generally inverted-T shaped section. The right-hand end of the end launching rail module 13 shown in FIGS. 2A and 2B is equipped with opposed horizontally projecting studs 25 and 27 on opposite sides of the module. One use of the studs 25 and 27 is to engage with a bearing pad 29, shown in FIGS. 3A, 3B and 3C. The bearing pad 29 is shown in outline in FIGS. 2A and 2B. The purpose of the bearing pad 29 is to distribute the load of a bridge, when formed on the launching rail, on the bank of a span. There will be one bearing pad 29 at each end of the bridge. The pads 29 conform to the profile of the toe of the bridge and therefore present their upper surfaces as part of the bridge decking in use.

Each of the launching rail modules is of a lightweight hollow construction of rectangular section. The depth and width of each module is such that it can be accommodated beneath a bridge formed from bridge modules, which will now be described.

Figure 4A:
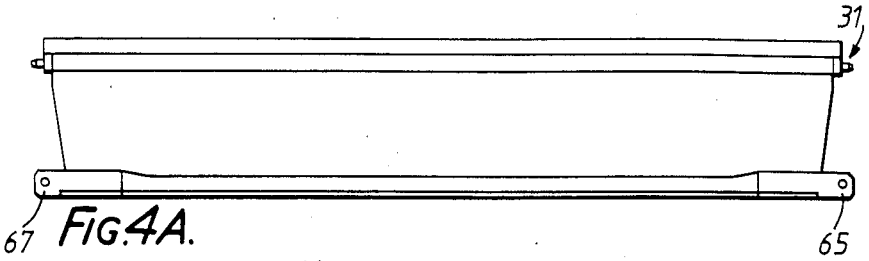
FIGS. 4A, 4B and 4C show side elevation, plan and end views of an intermediate bridge module in its open position.
Figure 4B:
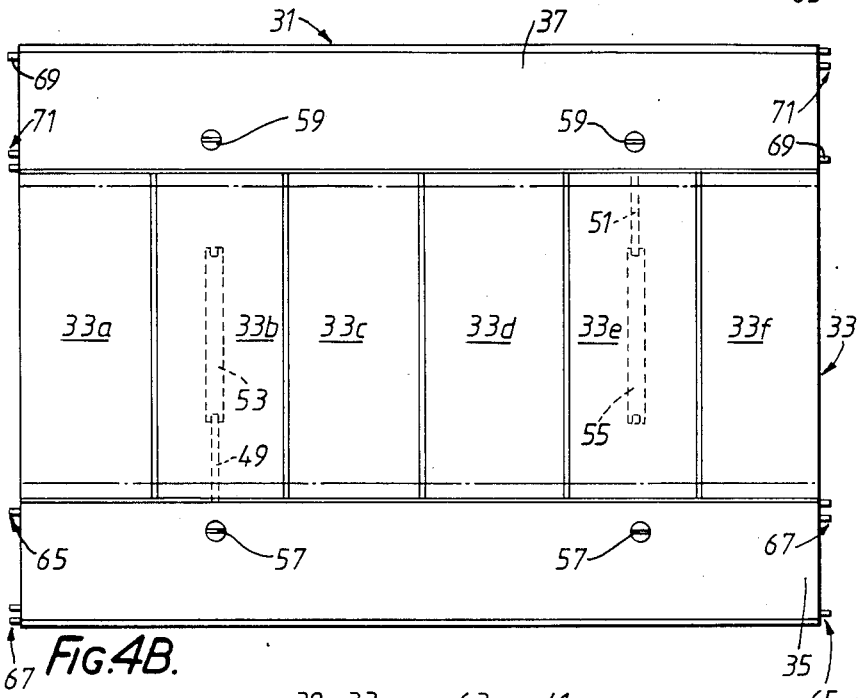
Figure 4C:
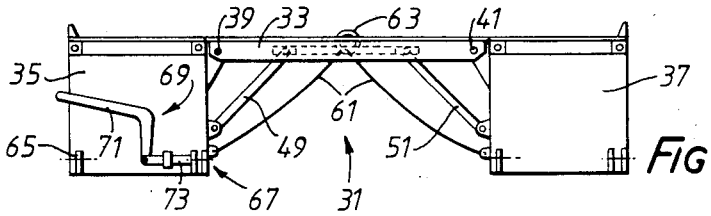
Figure 4D:
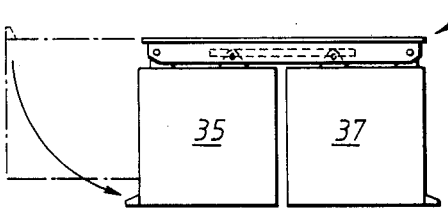
FIG. 4D shows an end view of the module in its folded position.

As can be seen from FIGS. 4A, 4B and 4C, which illustrate an intermediate bridge module 31 in its open state, the modules envisaged for use in the present invention are substantially the same as those disclosed in No. EP-A-0081388, the disclosure of which is incorporated by reference into this application. Each intermediate bridge module 31 comprises a centre decking 33 and left and right main girder structures 35 and 37 which can pivot about a respective axis 39 or 41 (FIG. 4C) to adopt the folded configuration shown in FIG. 4D for the purposes of transport.

Figure 4E:
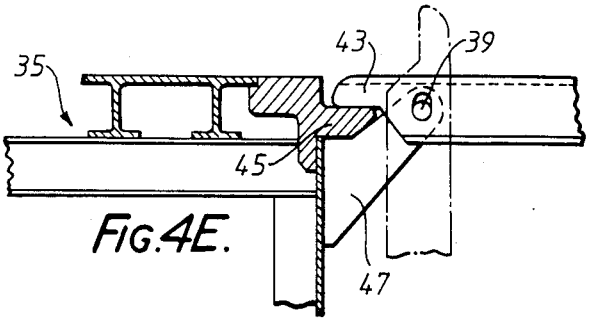
FIG. 4E shows a detail of construction of the intermediate bridge module.

The decking 33 for each intermediate module 31 is formed of six generally planar decking members 33*a* to 33*f* (FIG. 4B), each side of which has a lip 43 (FIG. 4E) which, in the open position of the module, bears on a shoulder 45 of the adjacent main girder structure 35. A support arm 47 extending from the main girder section 35 bears the pivotal connection between the decking 33 and the main girder structure 35.

Pivotally mounted on each of the main girder structures 35 and 37 is a respective bracing arm 49 or 5I, whose free end engages in a respective slide 53 or 55 (FIGS. 4B) at the underneath of the centre deck 33. The bracing arms 49 and 51 move in their respective slides 53 and 55 during folding and unfolding of the intermediate bridge modules 31.

Recessed lifting points 57 and 59 are provided in each main girder structure. When it is desired to unfold a bridge module from its folded (transport) position shown in FIG. 4D to its deployed, open position shown in FIGS. 4A, 4B and 4C, the module is simply lifted by means of a crane using a sling attached at the lifting points 57 and 59. The main girder structures 35 and 37 will swing of their own accord out from under the deck 33. The unfolding of the intermediate bridge modules is described in detail in No. EP-A-0081388 and will not be repeated here, but it should be noted that the length of the sling can be chosen so that the line of action passes almost through the centre of gravity of the cross section of the intermediate bridge modules as they are unfolded. In this way, the load on the sliding bracing arms 49 and 51 and their stops which are mounted in slides 53 and 55 is minimised. Shock absorbers can additionally be fitted to reduce shock load.

As can be seen in FIG. 4C the intermediate bridge modules 3I is provided with a recovery sling 61, which comprises wires each attached to a lower portion of a surface of a respective one of the main girder structure 35 and 37 which is inwardly facing when the module is open, the wires terminating in a common ring 63, which is accessible from above the centre deck. To close the intermediate module 31, the module is simply picked up by a crane acting at the ring 63. Of its own accord, the module will fold to the position shown in FIG. 4D.

Again, the general principle of the folding process is described in No. EP-A-0081388 and will not be repeated here.

As for the dimensions of the intermediate bridge module, it is again 19 feet 6 inches in length (5.94 meters) to be compatible with the ISO 6.1 meter (20 feet) container system. When the module is in its folded condition, it is 8 feet (2.44 meters) in width, again to be compatible with the ISO container requirements, but in its open position the total width of the intermediate bridge module 31 is 13 feet 5 inches (4.1 meters), which is a sufficient width for carrying such heavy vehicle as tanks. Each of the main girder structures 35 and 37, over which the tracks of the tanks pass, is 40.5 inches (1.03 meters) in height (in the open position) and 39 inches (1 meter) in width (again in the open position).

Successive bridge modules are coupled together by means of nesting hermaphrodite joining plates 65, 67, 69 and 71, through holes in which a pin can be inserted. The nests of joining plates are arranged to be at the corners of the main girder structures 35 and 37. It will be appreciated that the most difficult nest for a pin to be passed through is the lower, inner nest, at which the joining plates 67 are located in FIGS. 4C. To obviate the need for a man to climb under the bridge during construction, a remote pin shooting apparatus 69 is provided. The pin shooting apparatus comprises a bell-crank lever 71, one end of which projects for the operator's use at the outer edge of the main girder structure 35, and the other end of which connects with a pin 73 to push the pin through a nest of joining plates 67 (and 65 of the next module). Pins through upper joining dowels can be inserted by a man on the deck 33 of the bridge module 31.

The tapered end bridge module 75 shown in FIGS. 5A to 5D has many features in common with the intermediate bridge module 31, but differs in that the main girder structures 77 and 79 are tapered when seen from the side, when the module is in its open (deployed) position. The end module 75 again comprises a deck 81, but this time only five deck members 81*a* to 81*e* are provided. The deck member at the fully tapered end of the end module 75 (the right-hand in FIGS. 5A and 5B) is missing: its place is taken in the fully assembed bridge by the bearing pad 29. The deck section 81*e* nearest the fully tapered end is provided with a connection 83 for connecting the module to the launching rail, as will subsequently be described.

Figure 5A:
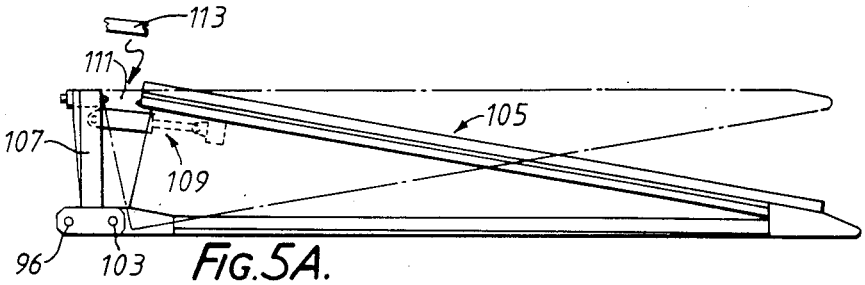
FIGS. 5A, 5B and 5C show side elevation, plan and end views of an end bridge module in its open position.
Figure 5B:
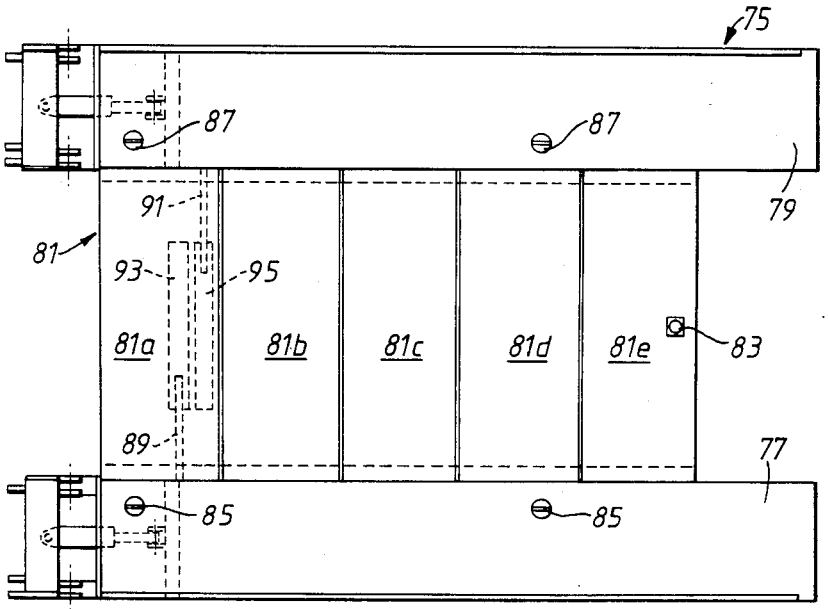
Figure 5C:
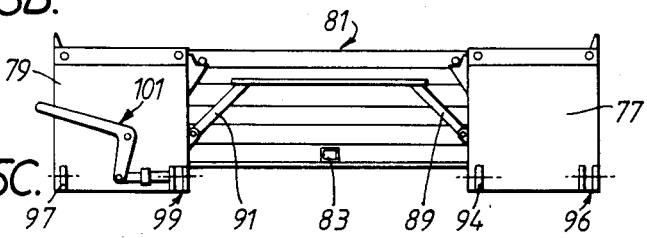
Figure 5D:
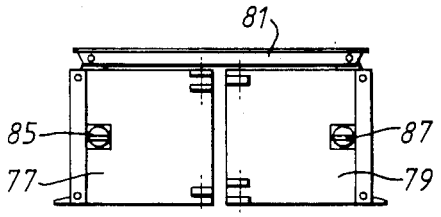
FIG. 5D shows an end view of such module in its folded position.
Figure 5E:
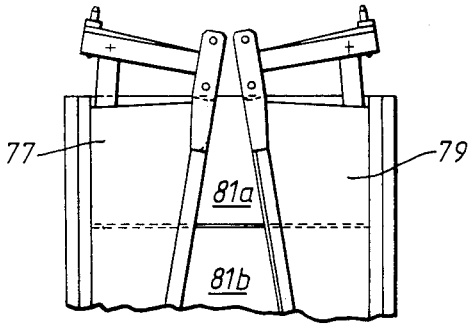
FIG. 5E shows a partial underneath view of a folded end module.

As with the intermediate bridge module 31, the end bridge module 75 can be opened from a closed position (shown in FIGS. 5D and 5E) to an open position (shown in FIGS. 5A, 5B and 5C) by lifting the end module 75 at recessed lifting points 85 and 87 on the deck-extension surfaces of the main girder structures 77 and 79 by means of a crane. A recovery sling (not shown) for the reverse operation is also provided. Opening and closing the end modules 75 is again very similar to the process described in No. EP-A-0081388 and will not be repeated here.

Bracing arms 89 and 91 each attached to a respective main girder structure (77 or 79) by a pivot extend towards and terminate in slides 93 and 95 under the lower surface of the deck 81. Their purpose is the same as for the intermediate bridge module 31. Joining plates 94, 96, 97 and 99 are also correspondingly positioned for joining the end bridge modules 75 to its adjacent intermediate bridge module 31. A pin shooting mechanism 101 is again provided.

A difference between the end bridge module 75 and the intermediate bridge module 31 is that the end bridge module 75 is articulated by way of a pivot 103 at a lower portion of the end bridge module adjacent where it is connected to an intermediate bridge module 31. The articulation means that the end bridge module is split into a ramp section 105 and a joining section 107. The ramp section 105 can be moved relative to the joining section 107 by means of a hydraulic piston and cylinder arrangement 109 mounted at the joining end of each main girder structure 77 and 79. At one extent of the articulation (used when the bridge is being assembled on the launching rail and boomed out across the span it is to bridge) the upper surface of the deck 81 is level. This is shown by the discontinuous lines in FIG. 5A. At the other extent of the articulation the lower surfaces of the main girder structures 77 and 79 are level. This is usually, though not exclusively, the position adopted when the bridge is in use for carrying traffic. This configuration is shown in solid lines in FIG. 5A. In such a configuration, there will be a gap 111 above the point of articulation at the pin 103. The gap 111 can be filled in use by a deck compression unit 113, which is a planar narrow deck extension unit. Hydraulic pressure in the piston and cylinder arrangement 109 can be relaxed once the deck compression unit is in place.

Figure 6A:
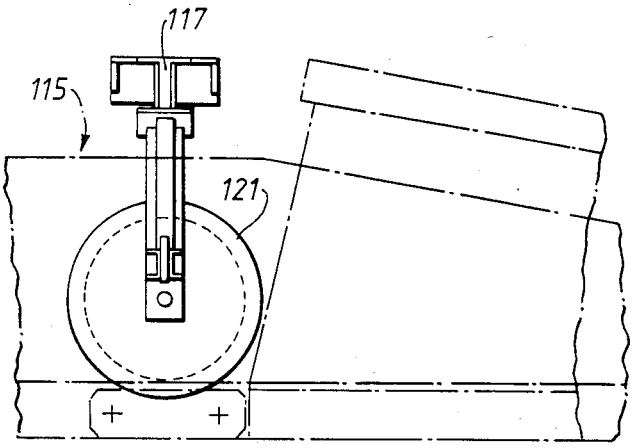
FIGS. 6A, 6B and 6C show side elevation, plan and end views of a sub-frame for bracing a bridge and for supporting bridge modules on a launching rail.
Figure 6B:
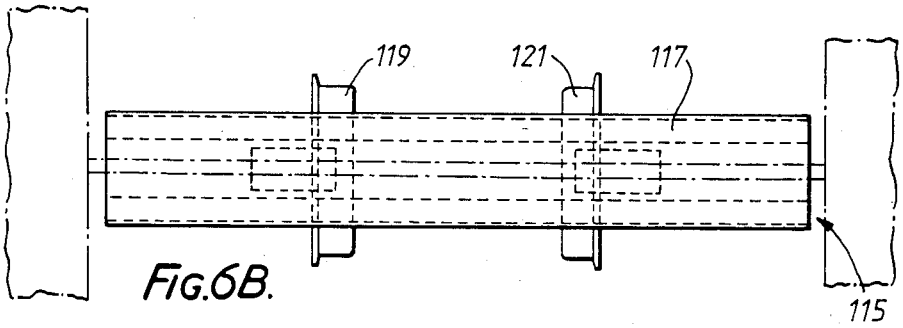
Figure 6C:
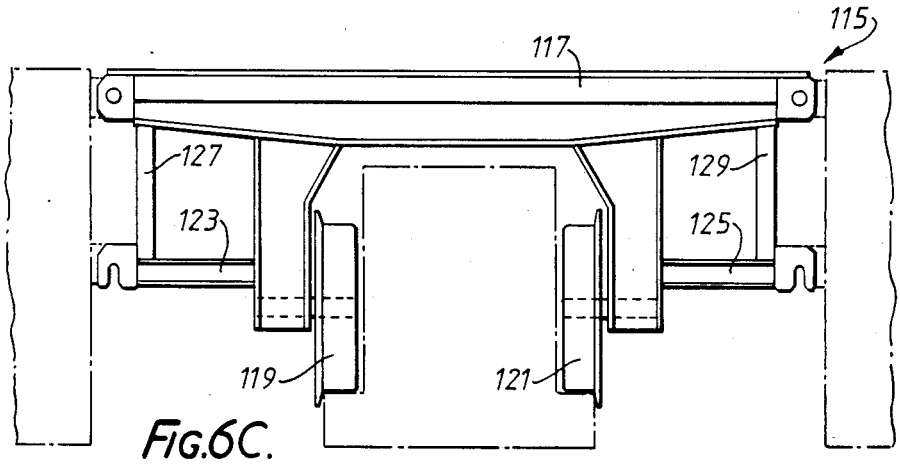

The maximum overall dimensions for the end bridge module 75 are the same as for the intermediate bridge module 31. FIGS. 6A, 6B and 6C show an inter-trackway bracing frame. One of these is located under the deck at each end of the bridge formed from end and intermediate bridge modules 75 and 31 and allows the bridge to be supported on a launching rail, formed from launching rail end and intermediate modules 13 and 1, during booming out.

The bracing frame 115 also braces the bridge in the open position. Each bracing frame 115 is fitted to one of the end bridge modules 75 and is located in the jaws at the joining section 107 of each end bridge module 75. The bracing frame 115 consists of a portal frame 117, on the inside of each upright of which is mounted a flanged wheel 119 or 121 on a horizontal axis for supporting the bridge on flanges of the launching rail (shown in dotted lines in FIG. 6C). Additional supports 123 and 125 extend outwardly from the uprights to make further engagement with the end bridge module 75. Additional vertical bracing 127 and 129 extends between the supports 123 and 125 on the one hand and the cross member of the portal frame 117 on the other hand.

FIGS. 7A to 7E give an overall view of a bridge 131 after construction. The bridge comprises three intermediate bridge modules 31 and two end bridge modules 75. These can clearly be seen in the side and plan views of FIGS. 7A and 7B. Underneath the deck of the bridge 131 can be seen (in dotted lines in FIG. 7B) a launching rail 133, which is itself formed of intermediate modules 1 and end modules 13. A bracing frame 115 can be seen in position in FIG. 7D.

Figures 7A, 7B, 7C, 7D, 7E:
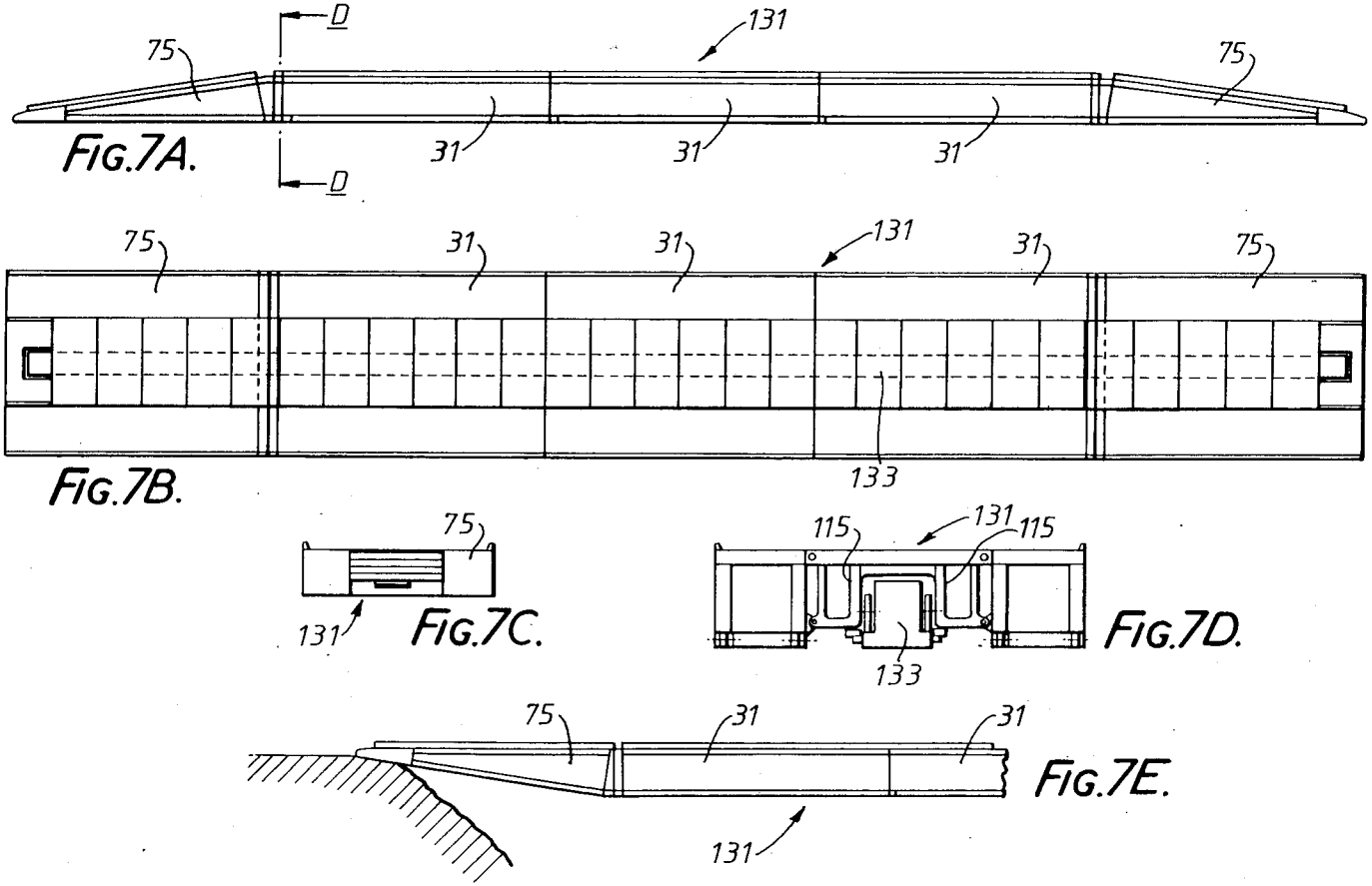
FIGS. 7A, 7B and 7C show side elevation, plan and end views of an assembled bridge.
FIG. 7D shows an enlarged section on D—D of FIG. 7A.
FIG. 7E shows a side elevation view of an alternative configuration of the end of a bridge.

FIGS. 7A and 7B show how the bridge 131 would be configured when spanning a gap between substantially level banks. Both bridge end modules are fully articulated. On the other hand, in FIG. 7E, the end module 75 is not articulated. This reduces the ramp slope at the end of the bridge and renders it more suitable for use on a sloping bank.

Figure 8:
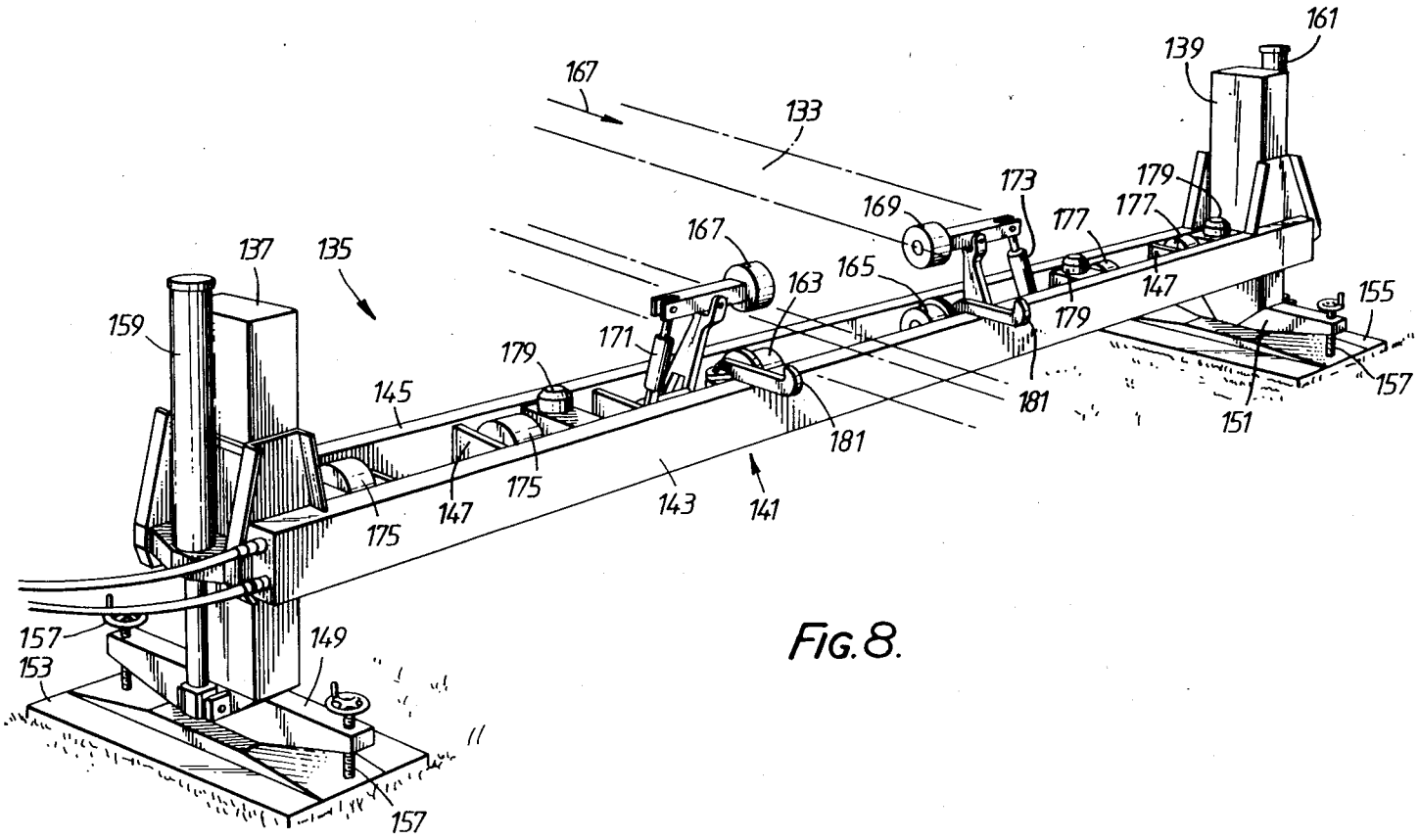
FIG. 8 shows a perspective view of a first embodiment of a first trestle for use in constructing a bridge.

FIG. 8 shows a trestle 135, which is the subject of one aspect of the invention and which can be used in accordance with a method of the invention. The trestle 135 comprises a pair of upright guide posts 137 and 139 of rectangular section, between which is movably and lockably mounted a support beam 141. The support beam 141 is constructed of two support beam members 143 and 145, interconnected by a number of spacers 147.

Each guide post 137 or 139 is mounted on a respective anvil-shaped beam 149 or 151, which is in turn supported on the respective base plate 153 or 155. Free ends of the anvil-shaped beams 149 and 151 are spaced from their respective base plate 153 or 155 by means of limit screws 157. The limit screws 157 are manually adjustable to give longitudinal level adjustment for the trestle 135.

The support beam 141 moves and is locked with respect to the guide posts 137 and 139 by means of hydraulic piston and cylinder arrangements 159 and 161, one associated with each guide post. Hydraulic fluid for the piston and cylinder arrangements 159 and 161 are supplied from a trestle hydraulic power pack supply (not shown).

Between the members 143 and 145 of the support beam 141 are mounted a variety of rollers. Two of them, 163 and 165, are launching rail support rollers powered by the trestle hydraulic power pack supply. They are flanged and have a surface with a high coefficient of friction so that they can drive the launching rail 133 shown in discontinuous lines in FIGS. 8 in the direction of the arrow 167, which is the direction of launching the launching rail 133, and eventually, the bridge 131. The launching rail support rollers 163 and 165 are centrally disposed along the support beam 141. Above each of the launching rail support rollers 163 and 165 is a respective retractable pinch wheel 167 or 169 mounted, like the launching rail support rollers, for rotation about a horizontal axis. The rotatable pinch wheels 167 and 169 bear upon the upper surfaces of the flanges 5 and 7 (see FIG. 1C) of each of the launching rail modules. When the retractable pinch wheels 167 and 169 are deployed, as shown in FIG. 8, they ensure that the launching rail support rollers 163 and 165 properly grip the launching rail 133 when driving it. The pinch wheels 167 and 169 can be retracted by hydraulic piston and cylinder arrangements 171 and 173, respectively.

Either side of the launching rail support rollers is a pair of bridge support rollers 175 and 177. They are again mounted for horizontal rotation. The pairs of bridge support rollers 175 and 177 support the lower surfaces of the main girder structures of the bridge 131, but are not powered. They are therefore passive, low-friction supports. Lateral guide rollers 179, mounted for vertical non-powered rotation, are position one either side of the path of the main girder structures of the bridge 131 during launching.

Two hydraulically retractable launching rail hooks 181 are mounted on the support beam 141 and extend in a downstream direction (as far as the direction of launch is concerned). They terminate in upwardly curved hooked portions. The hooks can pivot about horizontal axes to bring them out of and into engagement with the protrusions 25 and 27, respectively, (see FIGS. 2B) of a tapered end module 13 of the launching rail 133.

Figure 8A:
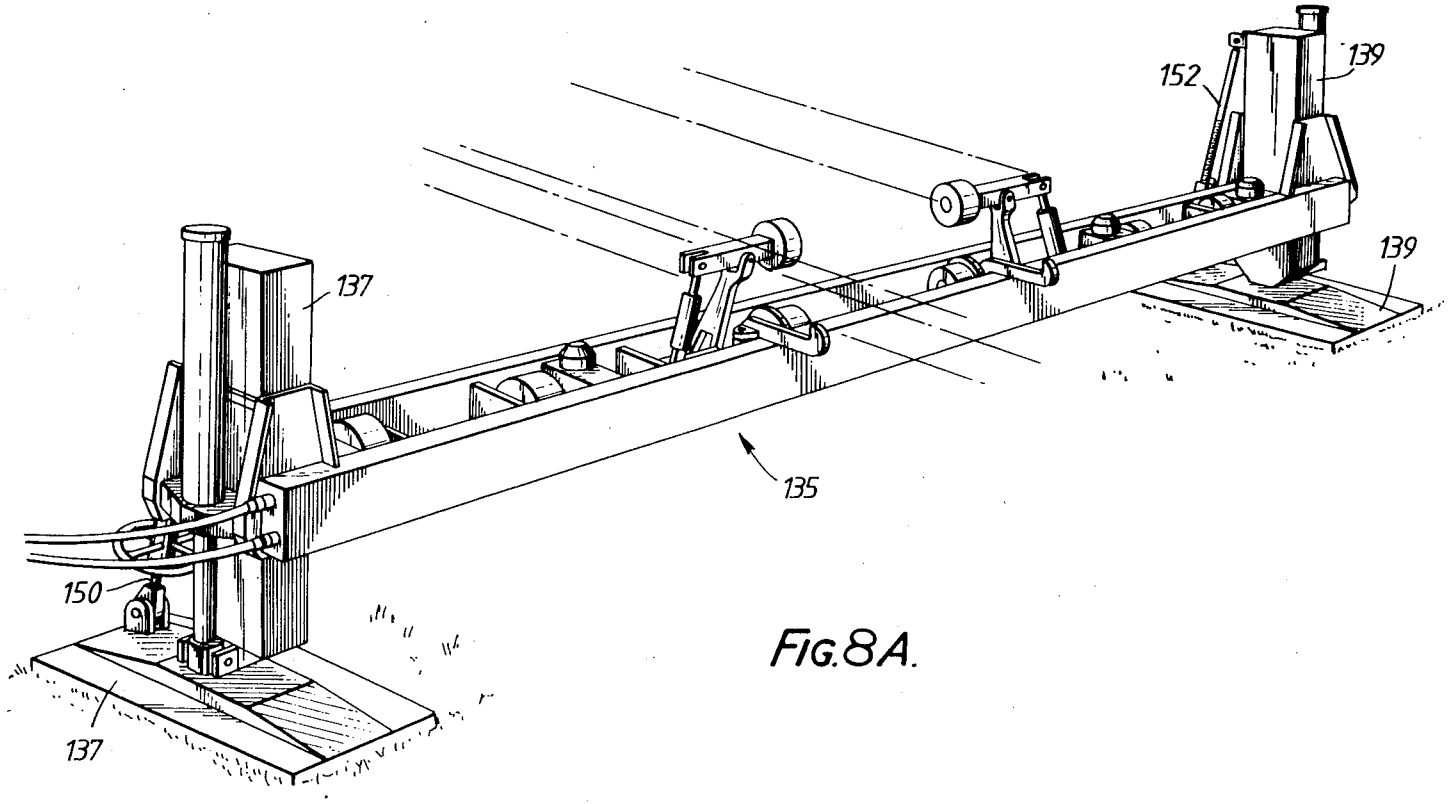
FIG. 8A shows a perspective view of a second embodiment of the first trestle.

FIG. 8A shows an alternative construction of the trestle 135, in which longitudinal level adjustment is achieved in a different way. The anvil shaped beams 149 and 151 are absent, and instead sloping tie rods or braces 150 and 152 are pivotally attached at their upper ends each to a respective one of the guide posts 137 and 139 and at their lower ends each to a respective one of the base plates 153 and 155. The length of each of the tie rods 150 and 152 can be adjusted in a similar fashion to a turnbuckle, as will be described later, with reference to FIG. 9A.

Figure 9:
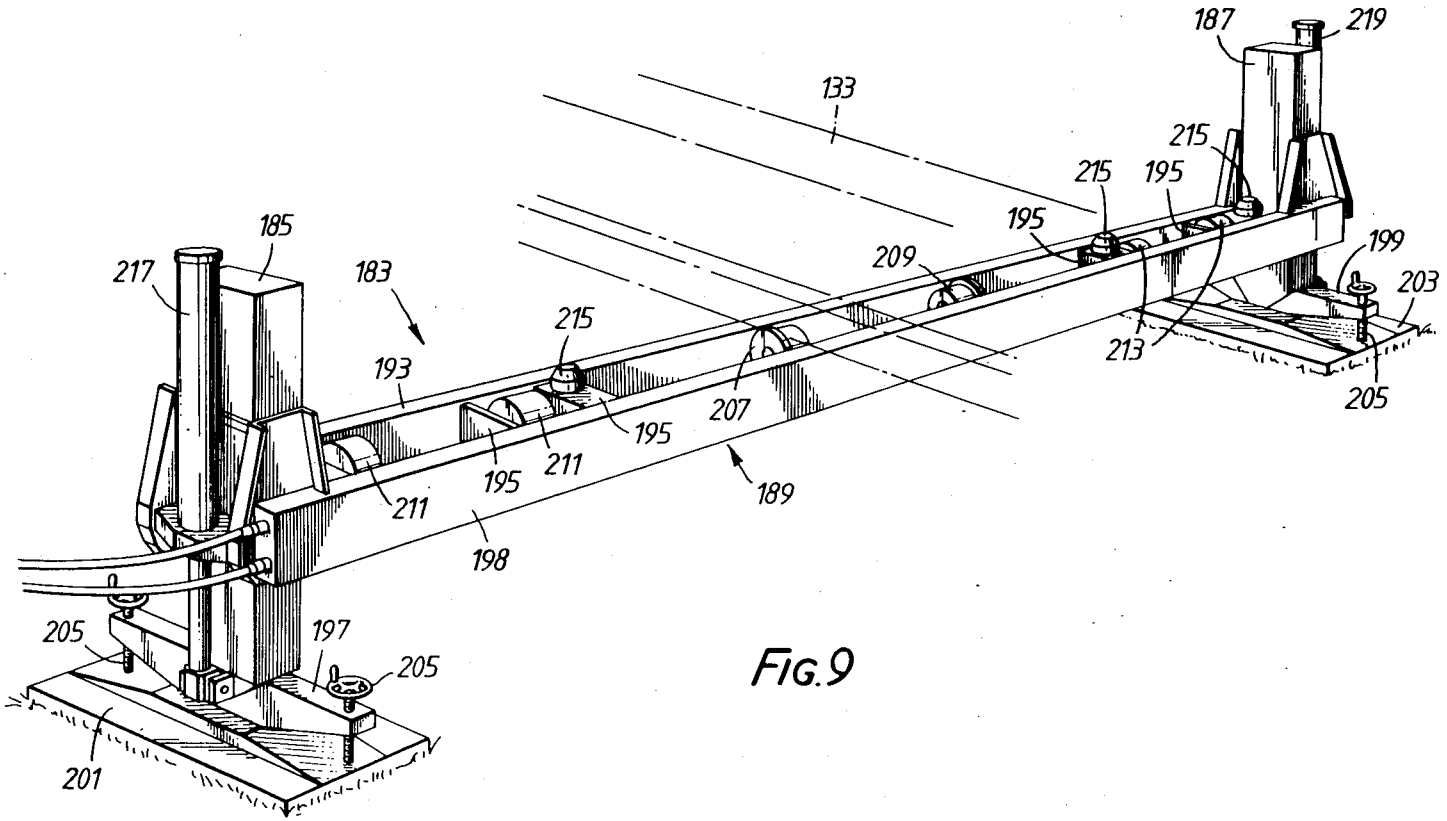
FIG. 9 shows a perspective view of a first embodiment of a second trestle for use in constructing a bridge.

A second trestle 183 is shown in FIG. 9. Two of these second trestles 183 are used in the preferred method of construction of the present invention. The second trestle 183 is broadly similar to the first trestle 135 except that (a) the second trestle 183 does not have to be of such heavy construction as the first trestle 135 because, in use, it does not have to withstand such heavy loading, and (b) the only interaction between the second trestle 183 and the launching girder 133 is such that the launching girder 133 is supported by non-powered rollers.

The second trestle 183 comprises a pair of vertical guide posts 185 and 187 which movably and lockably support a support beam 189 composed of two parallel girders 191 and 193 between which extend spacing members 195. Each of the guide posts 185 and 187 terminates at its lower end on a respective anvil-shaped member 197 or 199 whose centre portion rests on a respective base plate 201 or 203. Adjusting screws 205 allow for longitudinal level adjustment as with the first roller.

Either side of the centre of the length of the support beam 189 is a flanged roller 207 or 209, both of which act as launching rail support rollers. Pairs of bridge support rollers 211 and 123 are provided, as for the first trestle, as are lateral guide rollers 215, which are rotatably about a vertical axis and which limit lateral movement of the bridge modules 131 during construction of the bridge. Again, the vertical movement of the support beam 189 towards and away from the ground is provided by a pair of hydraulic piston and cylinder arrangements 217 and 219, each mounted on a respective guide post 185 or 187.

Figure 9A:
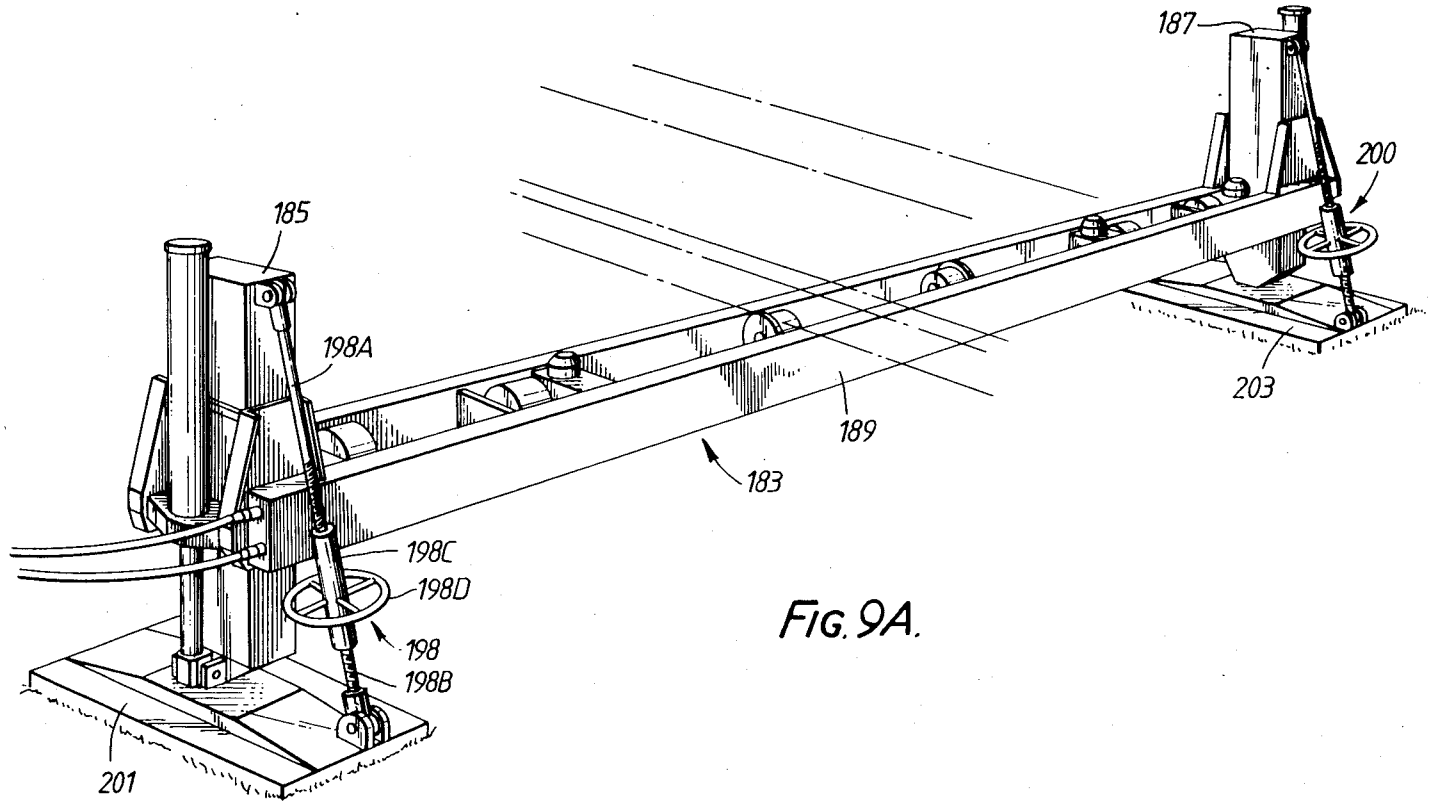
FIG. 9A shows a perspective view of a second embodiment of the second trestle.

FIG. 9A shows an alternative construction of the second trestle 183, in which longitudinal level adjustment is achieved in a different way. The FIG. 9A construction differs from the FIG. 9 construction in the same way that the FIG. 8A construction of the first trestle 135 differed from the FIG. 8 construction. The anvil shaped beams 197 and 199 are absent, and instead sloping tie rods or braces 198 and 200 are pivotally attached at their upper ends each to a respective one of the guide posts 185 and 187 and at their lower ends each to a respective one of the base plates 201 and 203. The length of each of the tie rods 198 and 200 can be adjusted in a similar fashion to a turnbuckle. This is achieved, as illustrated by way of example for the tie rod 198, by each tie rod (198 in this case) comprising an upper tie rod end 198A and a lower tie rod end 198B, which are formed at the ends that are not pivotally attached to the guide post 185 or the base plate 201 with left and right hand screw threads, respectively. (Which has the left thread and which has the right does not matter, as long as there is one of each.) The threaded ends of the upper and lower tie rod ends 198A and 198B both engage female-threaded ends of a central tube 198C, which carries a handwheel 198D. The central tube 198C lies along the central axis of the handwheel 198D. By turning the handwheel 198D, the length of the tie rod 198 can be increased or decreased in order to keep the guide post near vertical. The same principle applies to the second embodiment of the first trestle 135 shown in FIG. 8A.

Figure 12A:
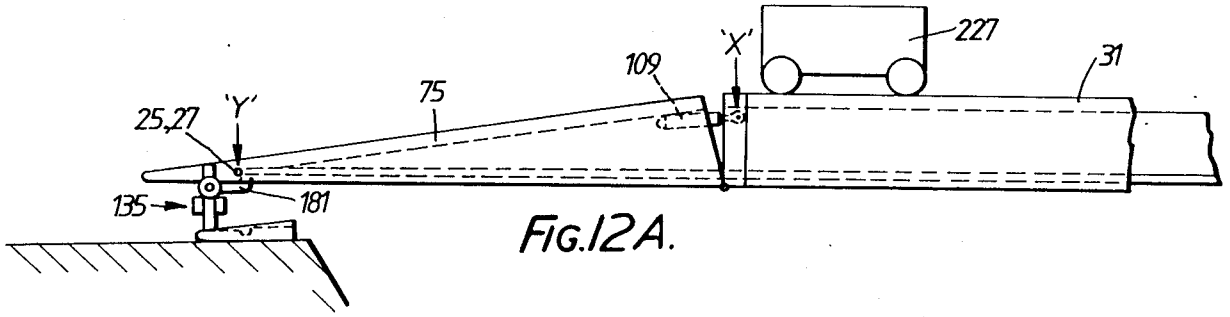
FIGS. 12A, 12B and 12C show concluding stages of the construction of the bridge at the home bank.
Figure 12B:
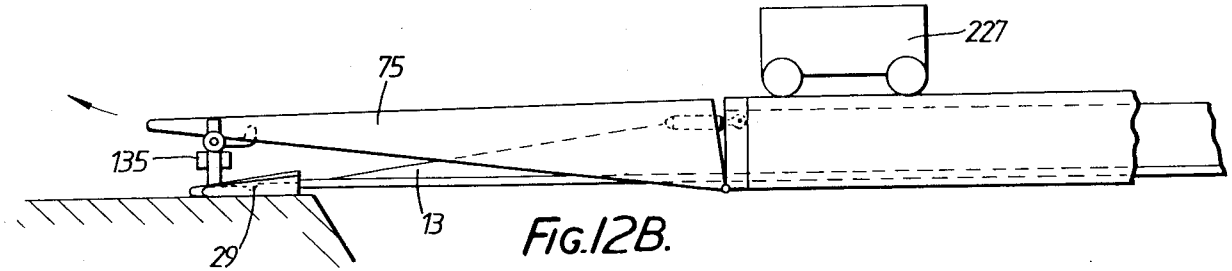
Figure 12C:
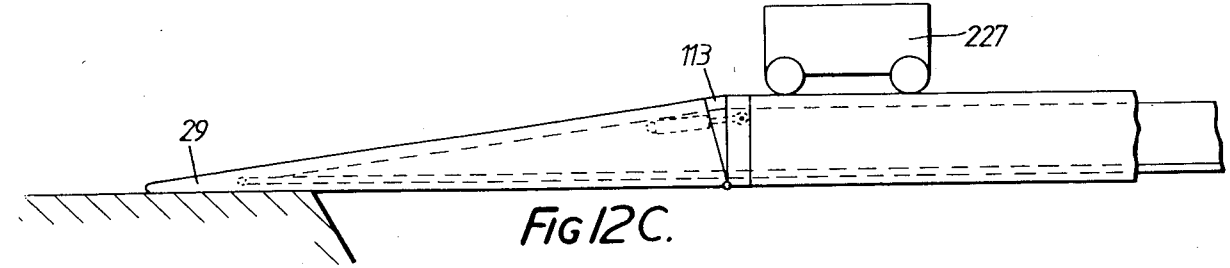

The use of such a levelling means, which comprises a tie rod of adjustable length extending between and pivotally attached to a guide post and a base plate, has the following two advantages. First, the need for coordinating the adjustment of the two adjusting screws 205 (FIG. 9)—that is, slackening one off before (or while) the other screw is being extended—is avoided. Secondly, the support beam 189 can be lowered further in view of the absence of the anvil shaped beams 197 and 199 (FIG. 9). This is significant when jacking down the home bank end of the bridge (see FIGS. 12A, 12B and 12C), because the minimum height to which the roller beam can be lowered determines the amount of upward articulation required on the tapered end ramps of the bridge in order to lower the launching rail to the ground. By adopting the alternative construction of FIG. 9A, the support beam can be lowered nearer the ground, and the articulation provided on the bridge end ramp can therefore be significantly reduced.

To construct a bridge by the preferred method in accordance with the present invention, it is particularly appropriate to use two hydraulic power packs. One would be positioned on the bridge under construction and would be used for articulating the bridge end modules 75 by means of the piston and cylinder arrangements 109. The other power pack would be located on the home bank and would be for raising and lowering the support beams 141 and 189 of the first and second trestles 135 and 183 and also for powering the friction drive rollers 163 and 165 of the first trestle, for moving the retractable pinch wheels 167 and 169 into and out of position and for moving the launching rail hooks 18I into and out of position.

Each portable hydraulic power pack can be powered by an air-cooled diesel engine of about 10 horsepower (7.5 kiloWatts) driving a variable displacement pump working at a presssure of 3000 psi (20.6 $MN/m^2$). The engine would be provided with hand or inertia start to obviate the need for batteries. Spare power units could be provided as a precaution against breakdown. In addition, an emergency hand pump could be provided to enable the bridge to be jacked down in the event of power failure. Recovery, however, would hardly be feasible with a manual pump, due to the height to which the bridge has to be jacked.

FIGS. 10A to 10G illustrate a method of constructing a bridge in accordance with the invention. The bridge illustrated is to be built of a total of five bridge modules (three intermediate bridge modules 71 and two end bridge modules 75) and is capable of reaching a span of 100 feet (30.5 meters) (nominal). For spans above 100 feet (30.5 meters) to 160 feet (48.8 meters), link reinforcement would be required. However, as some 95% of gaps in north-west Europe do not exceed 100 feet (30.5 meters), it is not foreseen that this will be a problem. Before construction proper can begin, all the components must be brought to the home bank. The components needed are as follows:

Three intermediate launching rail modules;
Two end launching rail modules;
Three intermediate bridge modules;
Two end bridge modules;
Two end pads;
One powered first trestle;
Two second trestles;
Two inter-trackway bracing frames; and
Two hydraulic power packs.

All these components could be brought to the site on a total of four 8T trucks which, in addition to the standard mobile crane would be all the vehicles needed for the bridge to be constructed. The crane would be expected to have a 3.5 tonne lift at a 15 feet (4.6 meters) outreach. The crane is designated by reference numeral 221 in FIG. 10.

Using the crane 221 free on wheels, the first trestle 135 is placed close to an parallel with the home bank. The second trestle 183 is placed parallel to the first trestle but some 15 feet (4.6 meters) parallel to and behind the first trestle 135. A first hydraulic power pack 223 is placed near the trestles in such a place that it can service the hydraulic requirements of the two trestles 135 and 183. With the crane 221 being positioned on the centre line of the bridge to be constructed, and the loaded trucks conveniently positioned alongside, an end launching rail module 13 is placed on two trestles with its toe towards the far bank. An end bearing pad 29 may be in position on the toe of the end launching rail module 13.

The crane 221 now lifts an intermediate launching rail module 1 into position for connection behind the end launching rail module 13. Because the intermediate launching rail modules only weight 0.8 tonnes, it is not necessary for the crane 221 to be chocked at this stage.

Figures 10A, 10B, 10C, 10D, 10E:
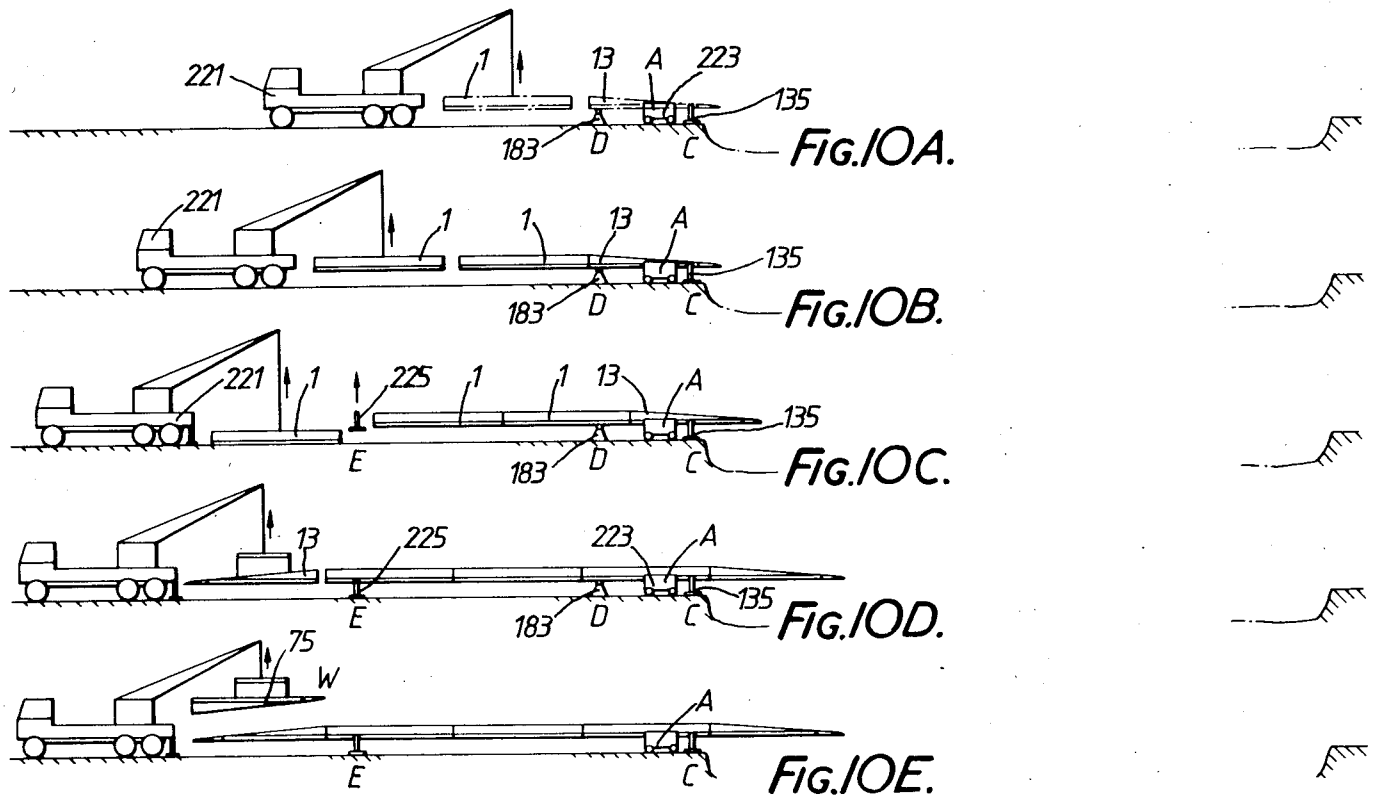
FIGS. 10A to 10N show successive steps in constructing a bridge in accordance with the invention.

FIG. 10B shows a second intermediate launching rail 1 being brought into position behind the first intermediate launching rail module 1, to which it is coupled. At this point, the launching rail being formed is boomed forward using a friction drive roller of the first trestle 135. This is done first to keep the centre of gravity of the launching rail being formed between the first and second trestles 135 and 183.

A third trestle 225, of identical construction to the second trestle 183, is placed towards the back of the launching rail being formed. The crane 221 is moved to its final position, where it is chocked by means of outriggers and jacks, as shown in FIG. 10C. A further intermediate launching rail module 1 is then lifted into position on the launching rail being formed. Finally, in this stage of the operation, a second launching rail end module 13 is lifted into position to complete the launching rail. At this point, the second trestle 183 can be removed, the weight of the launching rail being entirely supported now by the first and third trestles 135 and 225; it should be noted that the first power pack 223 continues to service the requirements of the first and third trestles 135 and 225.

When the last section (the second end module 13) of the launching rail has been connected, the launching rail is not boomed forward until a first bridge module (which will be an end bridge module 75) has been put in position on the launching rail. The positioning of the end bridge module 75 is shown in FIG. 10B. The end bridge module 75 will have been deployed in its unfolded position before fitting on the launching rail. At this point, a first roller bracing frame 115 is fitted between the trackways of the end bridge module 75, which is connected by means of a tension connection at position W (FIG. 10E) to the launching rail. Note that the end bridge module 75 is articulated upwards (in the position shown by the discontinuous lines in FIG. 5A) so that the upper chord is approximately horizontal. In this way the end bridge module 75 is appropriately aligned for connection to an intermediate bridge module. The launching rail is now boomed out by 20 feet (6.1 meters) and an intermediate bridge module 31 is connected to the end bridge module 75, again in its deployed position, connection to the end bridge module 75 is made by connecting pins. The lower chord outer pins are placed by hand. The lever mechanism 101 used for sliding the lower chord inner pins into position obviate the necessity for a man to go underneath the bridge. The upper chord tension connections can be made by a man standing on the deck. Each time subsequent intermediate bridge modules 31 are added, the bridge, still connected at point W to the launching rail, is moved forward the same distance (20 feet (6.1 meters)) by means of the drive rollers of the first trestle 135.

During this phase, a second hydraulic power pack 227 is positioned on the bridge deck and hydraulically connected to the piston and cylinder arrangements 109 of the end bridge module 75. As building proceeds, the droop of the launching rail can be counteracted by hydraulic adjustment of the articulation of the end launching rail module 75. As a further adjustment, the position of the support beam 141 of the first trestle 135 can be adjusted vertically by means of the hydraulic piston and cylinder arrangements 159 and 161 of the first trestle 135.

Figures 10F, 10G, 10H, 10I, 10J:
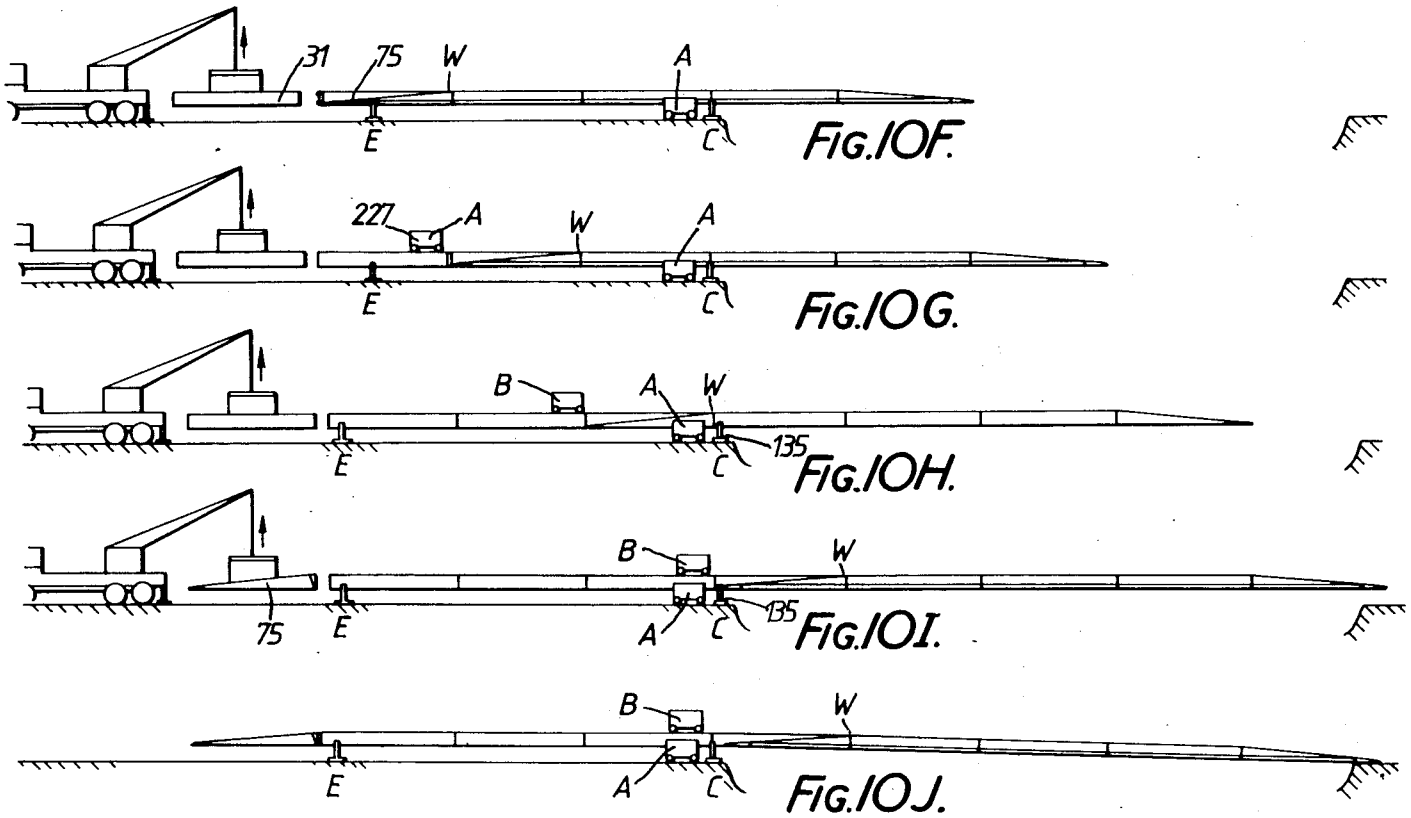

FIG. 10I shows the second end bridge module 75 being connected to the bridge. The second end bridge module 75 is articulated so that its lower chord is approximately horizontal. At this point, a second bracing frame is inserted between the trackways.

Figure 10K:
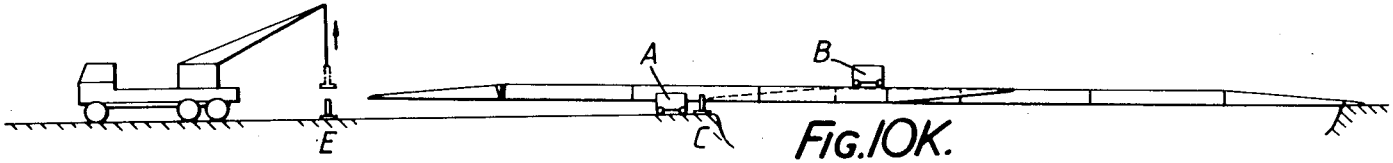
Figure 10L:
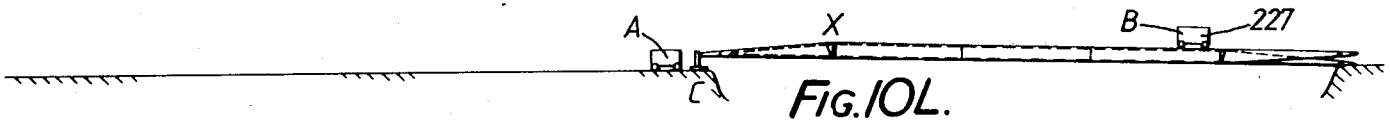
Figure 10M:
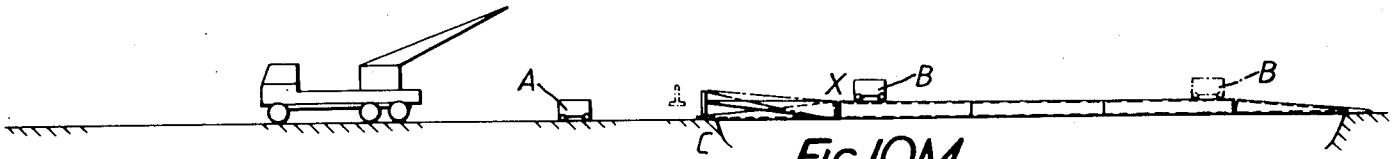
Figure 10N:
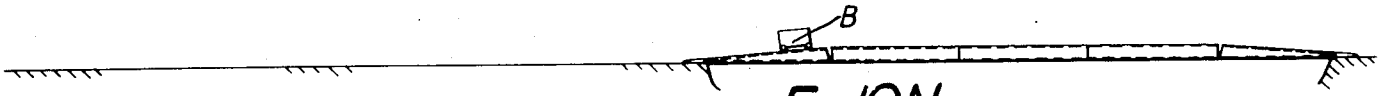
Figure 11A:
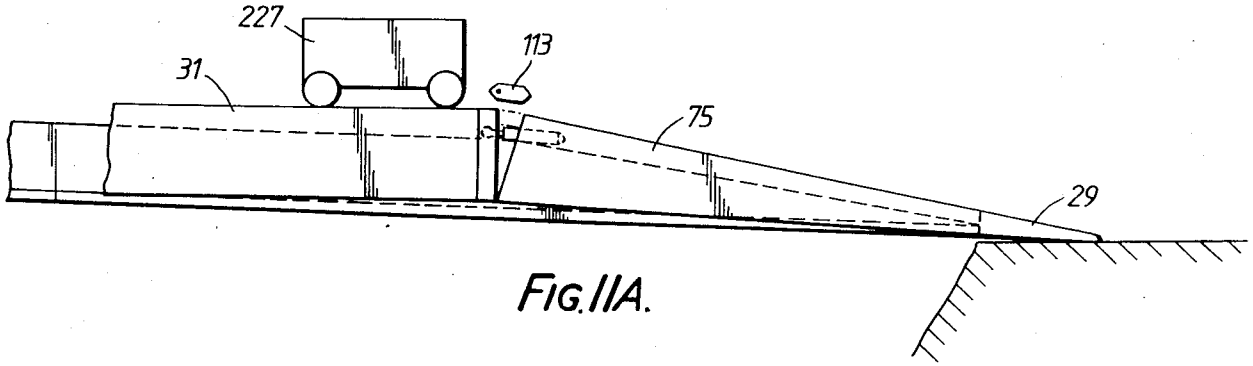
FIGS. 11A and 11B show steps in completing the construction of the bridge at the far bank.
Figure 11B:
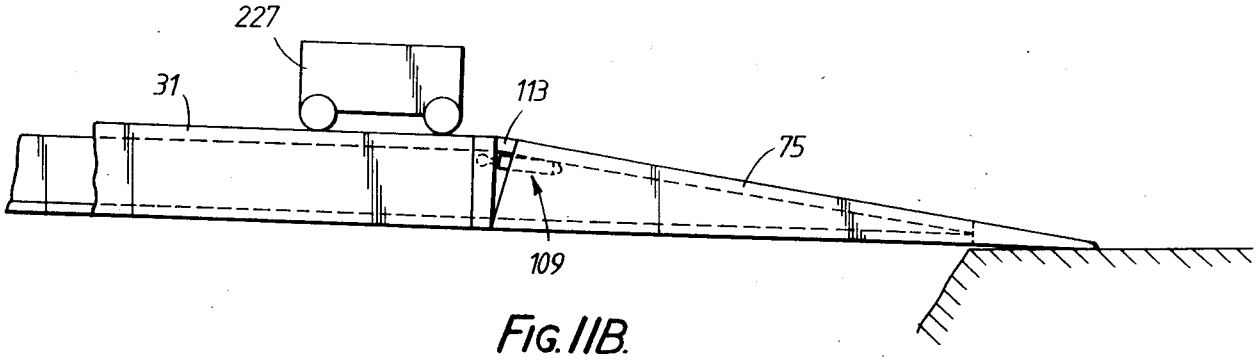

At this point, the bridge is ready for launching and jacking down. Because the bridge has been driven forward as each bridge module 31 or 75 has been added, the far end of the launching rail will be over the far bank when the second end bridge module 75 is assembled. The launching rail must be driven as far forward as possible until the projections 25 and 27 of the second end launching rail module 13 are located in the hooks 181 of the first trestle 135. The bearing pad 29 on the first end launching rail module 13 can now be landed on the far bank by articulating the first end bridge module 75 and/or by lowering the support beam 141 of the first trestle 135. The launching rail now becomes a simply supported beam over which the bridge can be launched. The connection at W is now released and the bridge pushed across the gap or span by means of a booming vehicle, which could be the crane 221. This is shown in FIG. 10K. With the bridge fully launched, jacking down on the far bank can proceed (FIGS. 10L, 11A and 11B). The first end bridge module 75 is articulated downwards by using the second power pack 227 so that the launching rail is relieved of the load of the bridge. The deck compression unit 113, as shown in FIG. 11A, is inserted to transmit the top chord compressive load. The piston and cylinder arrangements 109 of the first end bridge module 75 can then be relaxed. Note that, as the ramps of the first end bridge module 75 are articulated downwards, the launching rail can move downwards from the roller bracing frame 115, thus relieving rollers 119 and 121 (FIG. 6C) of any load. The second hydraulic power pack 227 can now be disconnected and moved back along the bridge ready to jack down on the home bank.

The first stage of jacking down on the home bank (FIG. 10M and FIGS. 12A, B and C) involes making a tension connection between the launching rail and the bridge at point X. The hooks 181 of the first trestle 135 are retracted to disengage them from the protrusions 25 and 27 on the second end launching rail module 13. At this point, the weight of the home bank end of the bridge is borne by the toe of the second end bridge module 75 on the support beam 141 of the first trestle 135. The ramps of the second end bridge module 75 are then articulated upwards so that the toe of the second end launching rail module 13 will be lowered to the ground and into its seating in a second bearing pad 29, which has been positioned there to receive it. The launching rail can now support the weight of the bridge while the ramps of the second end bridge module 75 are articulated upwards to free the first trestle 135, which can be removed by the crane 221. The tension connection at X is now released and the ramps of the second end bridge module 75 are articulated downwards at the far end so as to relieve load on the launching rail and to allow a deck compression unit 113 to be inserted.

The bridge is now ready for traffic.

The launching rail remains in the bridge, ready for recovery, which can take place from either end, due to the symmetrical construction of the bridge.

It should be noted that if the launching rail is suspended from the tension connection marked X and from a corresponding one at the other end of the bridge, the lower connecting pins joining the end launching rail modules 13 to their respective neighbouring intermediate launching rail modules 1 can be removed. In this way, it is possible to reduce the end slope of the bridge, or even to have the level deck, by reducing the width of the deck compression units 13 shown in FIG. 5A, if the lower launching rail connecting pins are also removed.

It should be mentioned that, to achieve the various tension connections (as mentioned for points W and X) during construction of the bridge, each end launching rail module 13 and each intermediate launching rail module 1 is provided with a tension connection for connection to the centre decking of the bridge at the appropriate point. The sequence for recovery and dismantling the bridge is essentially the reverse of the launching sequence. The timing may be comparable.

It can thus be seen that a bridge of MLC 70 capability can readily be built with the minimum of specialist equipment and no specialist vehicles. It is anticipated that a nominal 100 feet (30.5 meters) span could be bridged with the aid of a crane and six men in less than 30 minutes by night. The 4 meter wide deck presented by the bridge in use should be sufficient for conveying the majority of ground based military equipment across the span.

What I claim is:

1. A method of constructing a modular bridge across a span having a home bank and a far bank, the method comprising the steps of:

(a) providing a plurality of bridge modules wherein each bridge module comprises two longitudinal main girder structures and an intermediate central deck having a deck surface capable of supporting vehicles, the central deck extending substantially the entire length of the bridge module; foldable connecting means foldably connecting the main girder structures to each side of the central deck in a manner such that the main girders are foldable between an operative position in which the main girder structures offer extensions of the deck surface on either side of the deck for use and a closed position in which the main girder structures are folded beneath the deck;

(b) placing at least a first trestle on the home bank of the span;

(c) placing a first module of a modular launching rail on teh trestle, thereby to start to form a launching rail, (d) connecting at least one subsequent module to the launching rail being formed, (e) placing a first bridge module on the launching rail, to thereby start to form a bridge, (f) connecting at least one subsequent bridge module to the bridge being formed, (g) booming out the launching rail across the span, and (h) launching the bridge across the span along the launching rail.

2. A method as claimed in claim 1, wherein the bridge comprises two end modules in each of which the main girder structures are longitudinally tapered in depth when seen from a side of the module and at least one intermediate module in which the main girder structures are not so tapered.

3. A method as claimed in claim 1, in which the main girder structures are box girder structures.

4. A method as claimed in claim 1, wherein each main girder structure comprises at least one first lifting attachment on a surface offering the extension of the deck surface.

5. A method as claimed in claim 4, wherein the at least one first lifting attachment is recessed.

6. A method as claimed in claim 1, wherein each main girder structure comprises at least one second lifting attachment on a surface which is facing a corresponding surface of the other main girder structure when the module is in the operative position.

7. A method as claimed in claim 1, wherein the deck comprises two lip portions and wherein each of the main girder structures comprises a shoulder portion, each of which lip portions bears on a respective one of the shoulder portions when the module is in the operative position.

8. A method as claimed in claim 1, wherein the module further comprises bracing means between the main girder structures for bracing the module when in the operative position.

9. A method as claimed in claim 1, the method comprising providing means for altering the angle of approach offered by an end bridge module.

10. A method as claimed in claim 9, wherein the altering means comprises one or more hydraulic piston and cylinder arrangements for articulating the end bridge module.

11. A method as claimed in claim 9, wherein a deck extension unit is provided for inserting in the end bridge module at a given angle of approach.

12. A method as claimed in claim 1, wherein at least one sub-frame is provided for bracing the bridge and for supporting the bridge on the launching rail.

13. A method as claimed in claim 12, wherein one sub-frame is provided towards each end of the bridge.

14. A method as claimed in claim 12, wherein the at least one sub-frame has a pair of rollers, one for bearing on each of a pair of flanges on the launching rail.

15. A method as claimed in claim 1, which method comprises placing a second trestle on the home bank to take proportion of the load of the modules.

16. A method as claimed in claim 15, wherein the second trestle comprises at least one launching rail support roller for supporting the launching rail, at least one bridge support roller for supporting the bridge and lateral guide means for the bridge modules.

* * * * *

UNITED STATES PATENT AND TRADEMARK OFFICE

CERTIFICATE OF CORRECTION

PATENT NO. : 4,665,577

DATED : May 19, 1987

INVENTOR(S) : Thomas S. Parramore

It is certified that error appears in the above-identified patent and that said Letters Patent is hereby corrected as shown below:

Title Page 30 ;

Reads: "Jun. 14, 1984 [GB] United Kingdom.....8415136"

should Read: --Jun. 14, 1984 [GB] United Kingdom.....8415136
Dec. 8, 1981 [GB] United Kingdom.....8137003--

Column 15, Claim 1, Line 2:

Reads: "on teh trestle, thereby to start to form a launching"

should read: --on the trestle, thereby to start to form a launching--

Signed and Sealed this

Eleventh Day of August, 1987

*Attest:*

DONALD J. QUIGG

*Attesting Officer*

*Commissioner of Patents and Trademarks*